United States Patent [19]

Tice

[11] 4,144,364

[45] Mar. 13, 1979

[54] CHRISTMAS TREE APPARATUS

[75] Inventor: William G. Tice, Princeton, N.J.

[73] Assignees: Charles F. Byrd, Washington, D.C.; William Dailey, Sterling Heights, Mich.

[21] Appl. No.: 882,997

[22] Filed: Mar. 3, 1978

[51] Int. Cl.[2] ..... A47G 33/04; A47G 33/06; A41G 1/00

[52] U.S. Cl. ..... 428/9; 428/8; 428/18; 428/19; 428/20

[58] Field of Search ..... 428/7–9, 428/18–21

[56] References Cited

U.S. PATENT DOCUMENTS

| | | | |
|---|---|---|---|
| 2,788,598 | 4/1957 | Surber | 428/8 |
| 3,163,573 | 12/1964 | Brooks | 428/8 |
| 3,499,818 | 3/1970 | Kent | 428/18 |
| 3,806,399 | 4/1973 | Cocjin | 428/20 X |
| 3,819,457 | 6/1974 | Mottel | 428/9 |
| 3,900,637 | 8/1975 | Byrd et al. | 428/18 X |
| 4,057,665 | 11/1977 | Szulewski | 428/20 X |

*Primary Examiner*—George F. Lesmes

*Assistant Examiner*—Daniel R. Zirker

*Attorney, Agent, or Firm*—Richard C. Woodbridge

[57] ABSTRACT

An artificial christmas tree apparatus includes a plurality of movable branches which are closeable and openable through the relative motion of an inner and outer tube arrangement which forms the trunk mechanism of the tree. Each branch includes a decorated leafy end and an oppositely located base end which is received in the trunk mechanism. The trunk mechanism comprises an outer tube having a first and a second aperture therein and an inner tube located within said outer tube. The inner tube includes a third and fourth aperture therein. The second aperture is larger than the first aperture and the third aperture is larger than the fourth aperture. The base end of each branch passes through said second, fourth, third and first apertures respectively and is anchored by a crimp located at one end of the branch. Relative motion of the inner and outer tubes causes the branches to move from a closed to an open position and vice versa. A stand supports the apparatus and may be employed to drive the trunk mechanism. Alternatively, manipulation of the branches themselves will cause the erection or collapse of the device.

5 Claims, 8 Drawing Figures

Fig. 1.
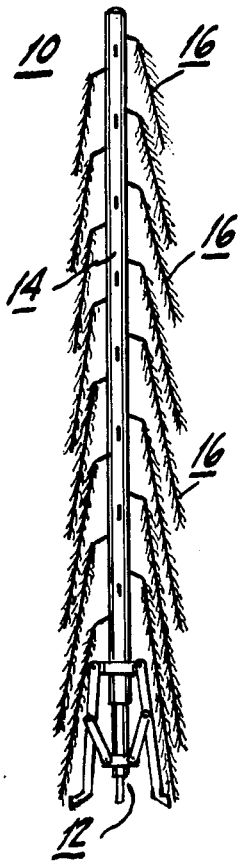
Fig. 2.
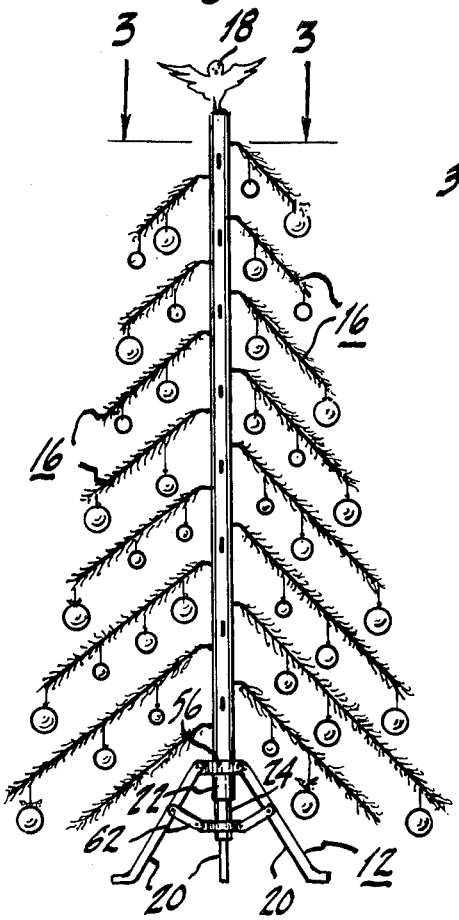
Fig. 3.
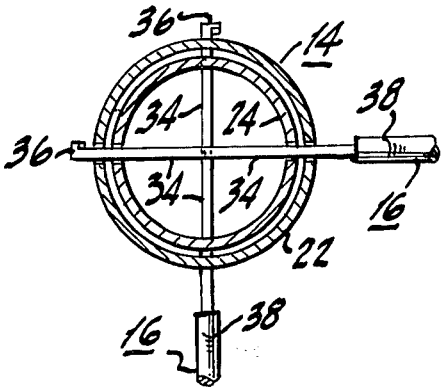
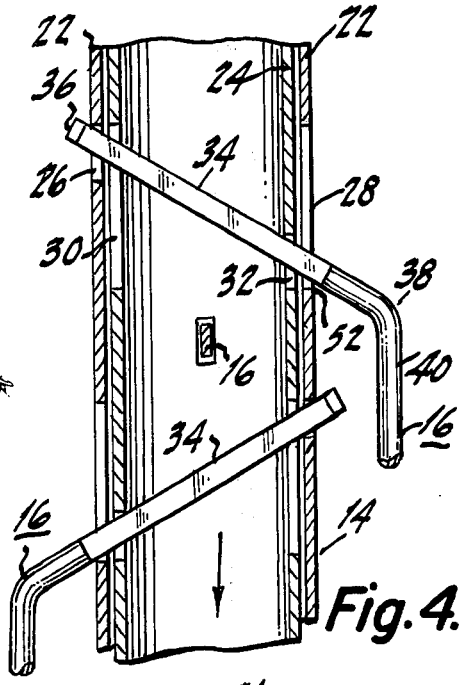
Fig. 4.
Fig. 5.
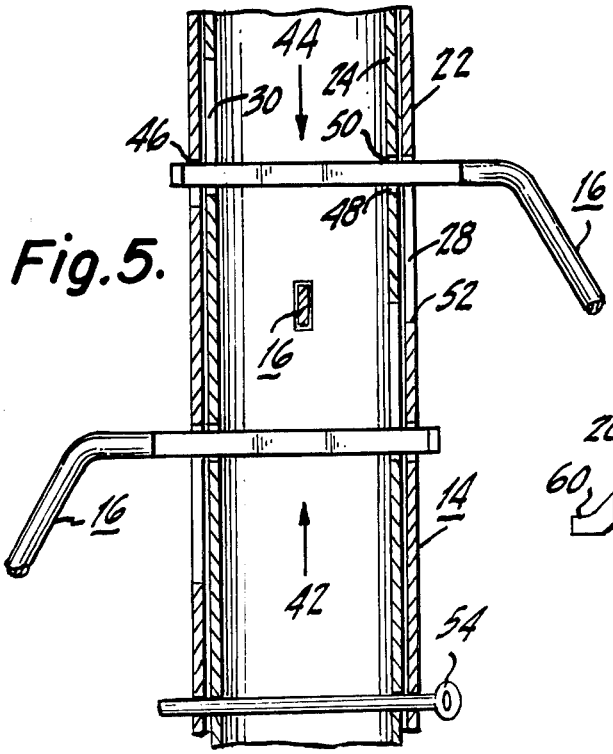
Fig. 6.
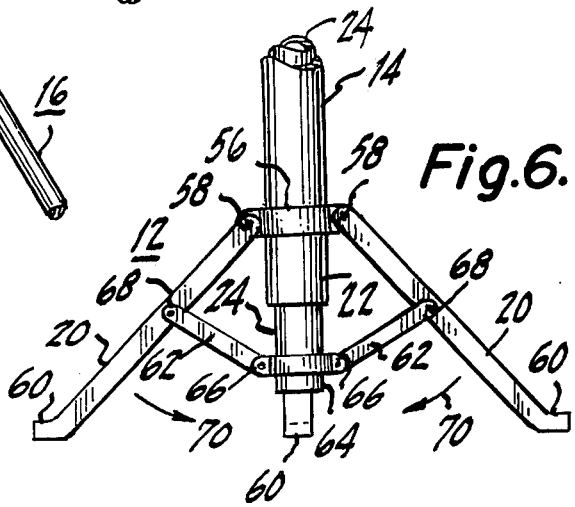

CHRISTMAS TREE APPARATUS

BACKGROUND OF THE INVENTION

1. Field of the Invention

This invention relates to an artificial Christmas tree having an improved branch moving mechanism.

2. Description of the Prior Art

In some respects the present invention is an improvement over U.S. Pat. No. 3,900,637 entitled "Collapsible Christmas Tree Apparatus" and issued on Aug. 19, 1975 to Charles F. Byrd and William Dailey. The Byrd et al device includes an outer tubular member and an inner rod means which are adapted to impinge upon one end of a plurality of rotatable branches. There do, however, appear to be some practical problems involved with that disclosed design. One of the problems is that the design requires special pinning and welding in order to allow the limbs to rotate in a satisfactory manner. That kind of structure can be expensive to produce. Additionally, the design requires a plurality of spacers which are adapted to impinge upon the free end of the rotatable branches. The production and alignment of a rod having such tabs poses some difficult manufacturing problems. Finally, the effective lever length of the base end of the tree limb is slightly less than one-half of the diameter of the outer trunk. Therefore, the leverage end of the branches is very small relative to the length of the limbs themselves. Accordingly, it may take a considerable effort in order to erect and collapse the apparatus. The following possibly relevant references were cited during the prosecution of U.S. Pat. No. 3,900,637: U.S. Pat. No. 1,590,220; U.S. Pat. No. 3,159,523; and U.S. Pat. No. 3,465,139.

There are several other types of artificial trees that are known to those of ordinary skill in the art. Wedden, U.S. Pat. No. 2,708,324; Osswald et al, U.S. Pat. No. 3,030,720 and Hermanson, U.S. Pat. No. 3,639,196, all disclose collapsible artificial christmas trees having branches which rotate upwardly so as to reduce the bulk of the tree for storage purposes. Similarly, Hutton, U.S. Pat. No. 2,988,837; Scherotto, U.S. Pat. No. 3,020,660 and Blake, U.S. Pat. No. 3,176,123, disclose artificial trees which may be readily erected and collapsed through the use of expanding or collapsing elements.

In contrast to collapsible artificial trees, there are also a number of artificial shrubs and the like which incorporate the use of plug-in branches. Trees of this sort, are disclosed in the patents to Circelli, U.S. Pat. No. 3,746,600 and Strony, U.S. Pat. No. 3,746,601. Circelli is of particular interest in that it discloses an artificial shrub in which the branches are plugged into hinged or rotatable sockets. In this fashion, the tube or other cylindrical container may be slipped around the Christmas Tree which causes the branches to rotate upward, thereby reducing the width of the tree and increasing the ease with which the tree may be stored. Finally, there is also the type of artificial tree which is not truly collapsible, but instead may be knocked down or set up as a construction project. For example, see Carlson, U.S. Pat. No. 3,031,785.

One of the major problems with prior art artificial trees is that they are relatively difficult to erect. In addition, many of the prior art trees are not sturdy enough to take normal abuse. Frequently a tree that is relatively easy to erect is often a weak structure. Conversely, the stronger artificial Christmas Trees tend to be difficult to erect. Accordingly, the present invention fills a clear need by providing an artificial tree which is relatively easy to construct and relatively sturdy in its erected state.

From a mechanical point of view there is some similarity between collapsible trees and the mechanisms which are associated with umbrellas or clothes line drying apparatus. For examples of prior art relative to those apparatus, see for example, Beegle, U.S. Pat. No. 1,075,395; Place et al, U.S. Pat. No. 2,269,317; Alexiou, U.S. Pat. No. 3,038,690; and Gray, U.S. Pat. No. 3,069,021; O'Neil, U.S. Pat. No. 3,091,249; Raynor, U.S. Pat. No. 3,163,297 and Nugent, U.S. Pat. No. 3,464,664.

SUMMARY OF THE INVENTION

Briefly described, the invention comprises a collapsible artificial tree which may be readily erected and collapsed and which shows improved stability and strength in the erected state. The artificial tree is preferably a christmas type tree, but might comprise a variety of other types of trees.

According to the preferred embodiment, the tree apparatus comprises a stand, a tree trunk mechanism supported by the stand and a plurality of movable tree branches connected to the trunk mechanism. Each branch includes a decorated end and a base end which passes through the trunk. The trunk mechanism includes an inner tube member surrounded by an outer tube member. The outer tube includes a first slot and a second slot on the opposite side of the outer tube member from the first slot. The second slot is longer than the first slot. The inner tube includes a third slot which lines up across from the first slot in the outer tube and a fourth slot which lines up across from the second slot in the outer tube. The third slot of the inner tube member is longer than the fourth slot. Each base end of each branch is connected to the trunk through the second slot, fourth slot, third slot, and first slot respectively. For each branch of the tree there is a corresponding plurality of four apertures to receive it in the trunk mechanism. Accordingly, if there were, for example, 32 branches on the apparatus, then there would be correspondingly, 128 slots in total in the trunk mechanism. The relative motion of the inner tube member with respect to the outer tube member causes the base end of the branches to rotate through approximately 30° of arc as the tree goes from its collapsed to its erected state or vice versa. The tree stand may be attached to the mechanism in such a fashion as to cause the trunk mechanism to erect the branches as the tree stand legs are spread in order to support the apparatus. Conversely the collapsing of the tree stand legs would cause the tree branches to collapse. Alternatively, the tree stand may be connected to the trunk mechanism in a passive manner. Therefore, the erection of the tree branches might be accomplished either through force applied to the tree branches themselves or, perhaps, through a supplementary lever mechaanism.

These and other features of the invention will be more fully understood with reference to the following drawings.

BRIEF DESCRIPTION OF THE DRAWINGS

FIG. 1 is an elevational view of an artificial collapsible christmas tree according to the preferred embodiment of the invention, in which the tree is illustrated in full collapsed state.

FIG. 2 is an elevational view of the tree illustrated in FIG. 1, in which the tree is shown to be in the fully erected state.

FIG. 3 is a partial cut away top plan view of the embodiment shown in FIG. 2.

FIG. 4 is a partial cross-sectional view of the trunk mechanism of the tree apparatus showing in detail the branches in the collapsed state as seen in FIG. 1.

FIG. 5 is a partial cross-sectional view of the trunk mechanism showing the branches in their erected state as illustrated in FIG. 2.

FIG. 6 is a detailed view of an embodiment of the stand mechanism in which the stand mechanism is employed to drive the trunk mechanism.

DETAILED DESCRIPTION OF THE INVENTION

Figure 7:
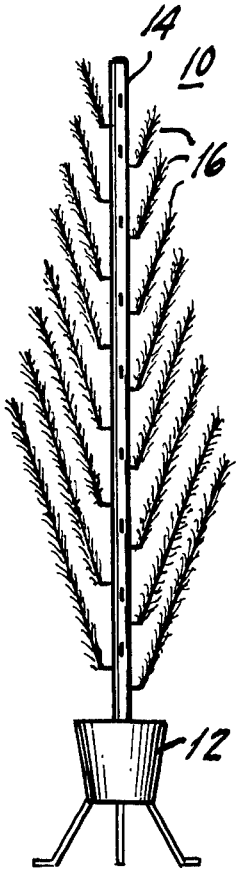
FIG. 7 is an elevational view of an artificial collapsible christmas tree according to an alternative embodiment of the invention, in which the tree is illustrated in the full collapsed state.

During the course of this disclosure like numbers will be used to designate like elements according to the different figures illustrating the invention.

The Christmas tree apparatus 10 according to the preferred embodiment of the invention is illustrated in its collapsed state in FIG. 1. The invention 10 includes a stand 12, a trunk mechanism 14 and a plurality of branches or limbs 16. The branches 16 would be decorated with artificial needles in the Christmas tree embodiment. According to alternative embodiments of the invention the decorations on the decorated ends of the limbs 16 might comprise leaves, flowers or other pseudo-natural vegetation. The tree apparatus may be topped with a suitable ornamentation figurine 18. In the case of the Christmas tree embodiment the figurine 18 might comprise an angel or the like.

The invention 10 is illustrated in its erected state in FIG. 2. In the erected state the legs 20 of the stand 10 are spread so as to provide a wider base. The legs 10 are mechanically linked to the trunk mechanism 14 in such a way as to cause the branches 16 to spread outward from the trunk mechanism 14. The angle of spread would typically be in the range of 30 to 45°. In addition, in the case of a Christmas tree or similar evergreen, the branches would become progressively shorter going downward toward the lower branches.

FIGS. 3, 4 and 5 illustrate in detail the operation of the trunk mechanism 14. FIG. 4 illustrates the trunk mechanism 14 in its closed position. Trunk mechanism 14 comprises an outer tube member 22 which surrounds an inner tube member 24. Outer tube member 22 includes a first slot aperture 26 and a second slot aperture 28 located diametrically across tube 22 from the first slot aperture 26. Similarly, the inner tube member 24 includes a third slot aperture 30 and a fourth slot aperture 32 located diametrically across from, that is to say 180° away from the third slot aperture 30. As clearly shown in FIG. 4, the second slot aperture 28 in outer tube member 22 is longer than the first slot aperture 26. With regard to the inner tube member 24, the third slot aperture 30 is longer than the fourth slot aperture 32. The first slot aperture 26 in the outer tube member 22 lines up next to the third slot aperture 30 of the inner tube member 24. Therefore, because the first and second aperture and the third and fourth apertures are respectively 180° removed from each other, the second slot aperture 28 will line up right next to the fourth slot aperture 32. In the relative positions just described, the four slot apertures 26, 28, 30 and 32 are aligned correctly to receive the flattened base end 34 of a branch member 16. A crimped section 36 of the base end 34 acts as an anchor to prevent the branch from slipping out of apertures 26, 28, 30 and 32. Base end 34 is connected through an elbow section 38 to the decorated end 40 of branch 16.

The slotted apertures are just slightly wider than the width of the flattened base end 34. Flattening the base end 34 serves to help prevent the branches 16 from rotating in a plane other than one parallel to the length of the trunk mechanism 14.

FIG. 5 illustrates the trunk mechanism 14 in the erected mode. In order to open the branches 16 in an outward direction, the inner tube member 24 is pushed upwardly relative to outer tube member 22 in the direction of arrow 42. As this occurs, the bottom edge of the fourth slot aperture 32 impinges upon the base end 34 and moves it upwardly. The other side of base end 34 nearest anchor 36 is prevented from moving upwardly by the upper edge 46 of the first slot aperture 26. Accordingly, as the inner member 24 moves upwardly in the direction of arrow 42, the branch 26 will rotate about point 46. Therefore in the erected state branch 26 will exert an upward force against point 46 and a downward force upon point 48 which acts as a fulcrum.

In order to collapse the tree the inner tube 24 is moved downwardly in the direction of arrow 44. This causes the top point 50 of aperture slot 32 to come in contact with base end 34. As upper edge 50 moves downwardly the base end 34 rotates in a clockwise direction around point 46. When the branch 16 comes to its final resting position as shown in FIG. 4, one edge of base end 34 may come to rest against the lower edge 52 of the second slot aperture 28.

There are several different ways in which the inner tube member 24 may be manipulated upwardly or downwardly with respect to the outer tube member 22. According to one embodiment of the present invention, the erection of the tree may be achieved by merely twisting one or two of the branches upwardly, thereby driving the inner tube member 24 in the upward direction of arrow 42. Under such circumstances the stand 12 would be a conventional stand which is rigidly, but collapsibly connected to the outer portion of the trunk mechanism 14 in a conventional fashion. Alternatively, the erection of the tree may be easily obtained by inverting the tree and letting the force of gravity pull the branches 16 in a counter clockwise direction. The tree 10 will tend to remain in an erected state due to the friction and stiction associated with the movable members. Alternatively, it might be desirable to add a locking pin or similar device to the trunk mechanism 14 in order to keep the tree 10 in the erected state. A suitable locking pin 54 is illustrated in position in FIG. 5.

The erection and collapse of the christmas tree may also be obtained through the use of a linkage system between the trunk mechanism 14 and the stand 12. A possible suitable erection and collapse mechanism is illustrated in FIG. 6. According to that embodiment the stand legs 20 are pivotally connected to the outer tube member 22 by a collar 56 having pivot tabs 58 connected to one end of each of the legs 20. The other end of each of the legs 20 is preferably capped by a rubber foot element 60. Each of the legs 20 is connected by a link 62 to the inner tube member 24. A collar 64 similar to collar 56 is firmly attached to the inner tube member 24. A plurality of pivot tabs 66 connects one end of each link 62 to the collar 64. The other end of link 62 is connected by a pivot member 68 such as a rivet to an intermediate point on each of the legs 20. The stand 12 illustrated in FIG. 6 6 is shown in fully erected state. This is identical to the state illustrated in FIG. 2. In order to collapse the entire apparatus two or more of the legs are moved in the direction illustrated by arrows 70. The movement of the legs 20 in the direction of arrow 70 causes the links 62 to draw the inner tube means 64 in the direction of arrow 44 thereby causing the mechanism to collapse to the state illustrated in FIGS. 1 and 4. Erection of the tree is accomplished by merely spreading the legs to the position shown in FIG. 6.

Figure 8:
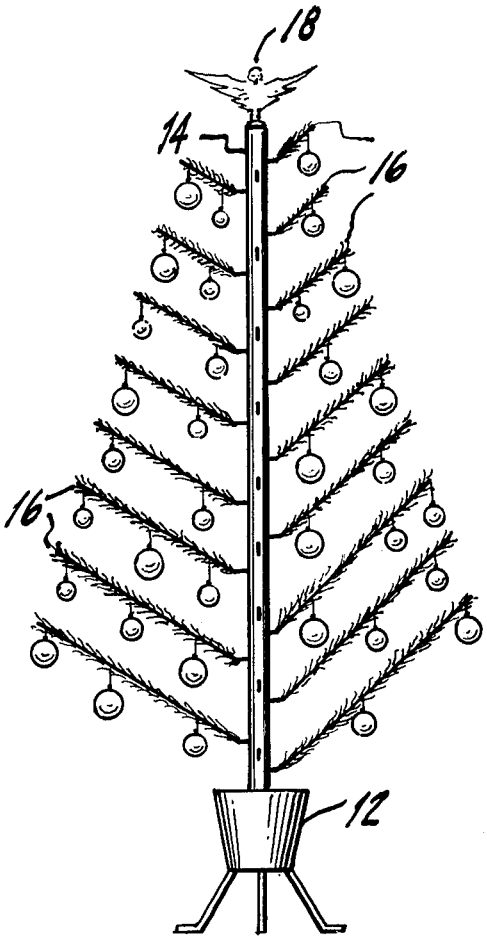
FIG. 8 is an elevational view of the tree illustrated in FIG. 7, in which the tree is shown to be in the fully erected state.

An alternative embodiment of the invention is illustrated in FIGS. 7 and 8. According to that embodiment the trunk mechanism 14 is inverted 180° from the orientation illustrated in FIGS. 1 through 6. Accordingly, in the collapsed state the branches 16 point upwardly as shown in FIG. 7. In the erected state the branches 16 move downwardly yet assume a slight upward orientation as illustrated in FIG. 8. There are several advantages to this alternative embodiment. First of all, the branches tend to open naturally under the influence of gravity. Therefore stand 12 can be a passive that is, non-mechanically linked, stand. Secondly, the force of gravity tends to lock the limbs 16 in the full open position, thereby eliminating the necessity of a locking pin 54 such as illustrated in FIG. 5: Thirdly, upwardly facing limbs are closer to the natural structure of evergreens than are downwardly facing limbs. However, one disadvantage of the alternative embodiment is that even though upwardly facing limbs are closer to the natural structure, most individuals associate downward facing limbs with Christmas trees and the like. Therefore, the upwardly facing limbs may look a little unusual to the ultimate consumer.

While the invention has been described with reference to a preferred embodiment thereof, it will be understood by those of ordinary skill in the art that various different modifications may be made to the structure without departing from the spirit and scope of the invention. For example, there probably are other mechanisms similar to that illustrated in FIG. 6 for achieving the erection and collapse of apparatus 10 through the manipulation of a stand element 12. It might also be possible to cause the erection and collapse of the apparatus through a lever mechanism not associated with the stand 12 or the branches 16. Most of the elements of the apparatus except for the foliage decorations the free ends 40 of the branches 16 and the feet 60 of the stand 12 are made of appropriate light weight metal, such as aluminum. Clearly plastics or similar materials might be substitutable under appropriate circumstances. It is believed that the apparatus would enjoy most of its usage at Christmas time as an alternative to the traditional Christmas tree. Clearly the foliage on the branches 16 could be something other than evergreen needles, such as synthetic holly leaves, flowers, or other similar vegetation. As seen from FIG. 3, the invention could comprise four rows of branches 16 and three foot sections 20. As shown in FIGS. 1 and 2, each row of branches could contain 8 individual branch members. The branches must be staggered so that their base ends do not interfere within the trunk mechanism. Typically the shorter branches 16 would be located at the top and they would increase progressively in length in a natural fashion towards the bottom of the apparatus. Under other circumstances it might be desirable to employ a greater or lesser number of rows of branches. Similarly, it could be desirable under other circumstances to employ a greater or lesser number of branches per row. It would also be possible to arrange the branches in a spiral fashion or a random fashion if so desired. These and other similar modifications are believed to be obvious to those of ordinary skill in the art given this disclosure.

What is claimed is:

1. A collapsible artificial tree apparatus comprising:

a plurality of tree branches, each branch having a base end and a decorated free end;

a hollow outer tubular means having a plurality of first and second apertures therein, said second apertures being longer in one dimension than said first apertures;

a hollow inner tubular means located within said hollow outer tubular means, said hollow inner tubular means including a plurality of third and fourth apertures therein, said third apertures being longer in one dimension than said fourth apertures, said first apertures being located next to said third apertures and said second apertures being located next to said fourth apertures; and, a stand means connected to said apparatus for supporting said apparatus, wherein the base end of each of said branches pass continuously through a second, fourth, third and first aperture respectively so that the relative movement of said hollow inner tubular means within said hollow outer tubular means causes movement of said branches from one position to another position.

2. The apparatus of claim 1 wherein said stand means includes a plurality of leg means and wherein the spreading of said leg means causes said hollow inner tubular means and said hollow outer tubular means to move in such a fashion as to cause the branches to assume a full open position.

3. The apparatus of claim 2 wherein said second and third apertures comprise slots in said hollow outer tubular means and said hollow inner tubular means respectively, said slots being oriented parallel to the long axis of said hollow inner and outer tubular means.

4. The apparatus of claim 3 wherein the base end of each of said branches includes an anchor means for preventing said branches from slipping through said first aperture.

5. The apparatus of claim 4 wherein the base end of each of said branches is substantially flattened.

* * * * *